US006434345B2

(12) United States Patent
Watanabe

(10) Patent No.: US 6,434,345 B2
(45) Date of Patent: Aug. 13, 2002

(54) IMAGE FORMING APPARATUS

(75) Inventor: Yukio Watanabe, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/781,395

(22) Filed: Feb. 13, 2001

(30) Foreign Application Priority Data

Feb. 18, 2000 (JP) ..... 2000-041672

(51) Int. Cl.[7] ..... G03G 15/00
(52) U.S. Cl. ..... 399/45; 399/53
(58) Field of Search ..... 399/45, 53, 55, 399/67, 222, 252, 281, 285

(56) References Cited

U.S. PATENT DOCUMENTS 5,049,906 A 9/1991 Kobayashi et al. ..... 347/156
5,781,839 A * 7/1998 Kikui ..... 399/296
5,845,171 A * 12/1998 Ko ..... 399/45 X
6,219,498 B1 * 4/2001 Katoh et al. ..... 399/45

FOREIGN PATENT DOCUMENTS

| | | |
|---|---|---|
| DE | 39 09 312 | 10/1989 |
| JP | 60-80885 | 5/1985 |
| JP | 60-86574 | 5/1985 |
| JP | 61-100770 | 5/1986 |
| JP | 61-149972 | 7/1986 |
| JP | 61-256366 | 11/1986 |
| JP | 63-269685 | 11/1988 |
| JP | 4-163465 | 6/1992 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an unfixed toner image forming device, and a fixing device, wherein a toner amount of the unfixed toner image forming device is smaller than a toner amount of the unfixed toner image formed on a second recording material having a thickness smaller than that of the first recording material by the unfixed toner image forming device. The image forming apparatus is thus able to form a good image on a thick recording.

16 Claims, 2 Drawing Sheets

IMAGE FORMING APPARATUS

BACKGROUND OF THE INVENTION

1. Field of the Invention

The present invention relates to an image forming apparatus such as a copying machine, a printer and the like, and more particularly, it relates to an apparatus having fixing means for fixing an unfixed toner image to a recording material.

2. Related Background Art

There have been proposed various methods and apparatuses for obtaining an image by using an electrophotography. For example, as disclosed in Japanese Patent Application Laid-Open No. 61-100770, there is a method in which latent images corresponding to the number of color decomposition of an original image are formed on a photosensitive drum as an image forming member and then are developed to form toner images, and, after a multicolor image is formed on a transfer drum by successively transferring the toner images thereon after every development, the multicolor image is transferred onto a recording material, thereby obtaining a color copy.

Further, for example, as disclosed in Japanese Patent Application Laid-Open No. 61-149972, there is a method in which latent images corresponding to the number of color decomposition of an original image are formed on a photosensitive drum as an image forming member and then are developed to form toner images, and the toner images are transferred onto a recording material after every development, thereby obtaining a multi-color copy.

Further, there is a method in which formation of latent images corresponding to the number of color decomposition of an original image on a photosensitive drum and development with color toners are repeated and, after color toner images are superimposed, they are transferred onto a recording material collectively, thereby obtaining a color image.

In a multicolor image forming apparatus in which the color image is obtained by superimposing, a thickness of the toner layer (color image) on the recording material is greater than a thickness of a toner layer (monochromatic image) obtained by a monochromatic image forming apparatus by two or three times, and, thus, the heat capacity of the entire toner layer becomes great, with the result that a difference in fixing ability between usage of a normal paper and usage of a recording material such as a thick paper having great heat capacity becomes noticeable.

Accordingly, when the image is formed on the thick paper, a line speed is decreased to increase a fixing nip time (refer to Japanese Patent Application Laid-Open Nos. 60-80885 and 60-86574).

With such an arrangement, the heat amount itself given to the toner layer is increased, thereby eliminating the difference in fixing ability.

In the above-mentioned conventional techniques, in case of the thick paper, since the line speed is decreased during the image formation, although the fixing ability can be maintained, through-put (the number of copies formed per unit time) is worsened.

SUMMARY OF THE INVENTION

An object of the present invention is to provide an image forming apparatus in which a good image can be formed even on a thick recording through-out.

Another object of the present invention is to provide an image forming apparatus comprising unfixed toner image forming means for forming an unfixed toner image on a recording material, and fixing means for fixing the unfixed toner image formed by the unfixed toner image forming means onto the recording material, and wherein a toner amount of the unfixed toner image forming means is smaller than a toner amount of the unfixed toner image formed on a second recording material having a thickness smaller than that of the first recording material by the unfixed toner image forming means.

The other objects and features of the present invention will be apparent from the following detailed explanation referring to the accompanying drawings.

DESCRIPTION OF THE PREFERRED EMBODIMENTS

Figure 1:
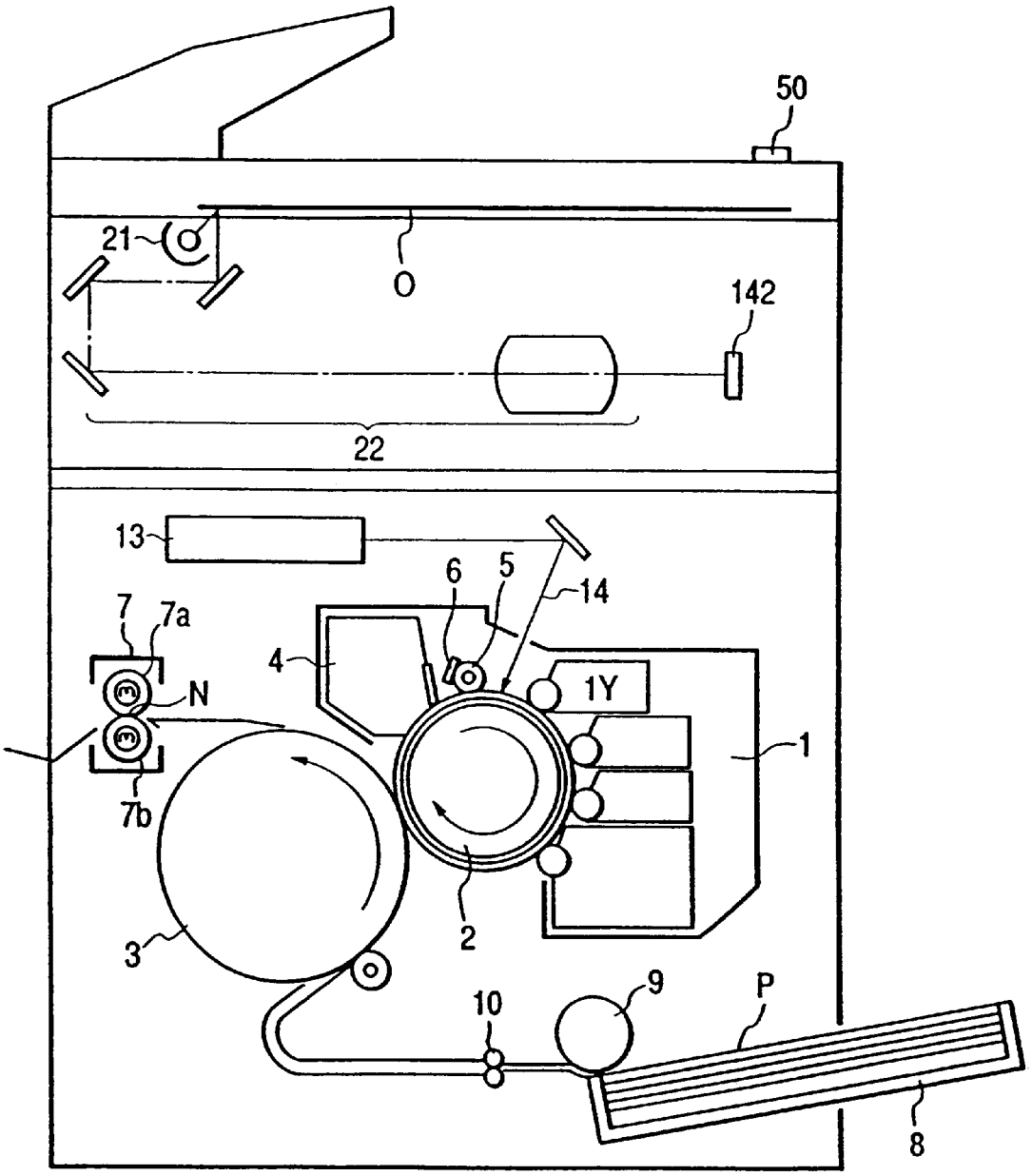
FIG. 1 is a view showing an image forming apparatus according to an embodiment of the present invention.
Figure 2:
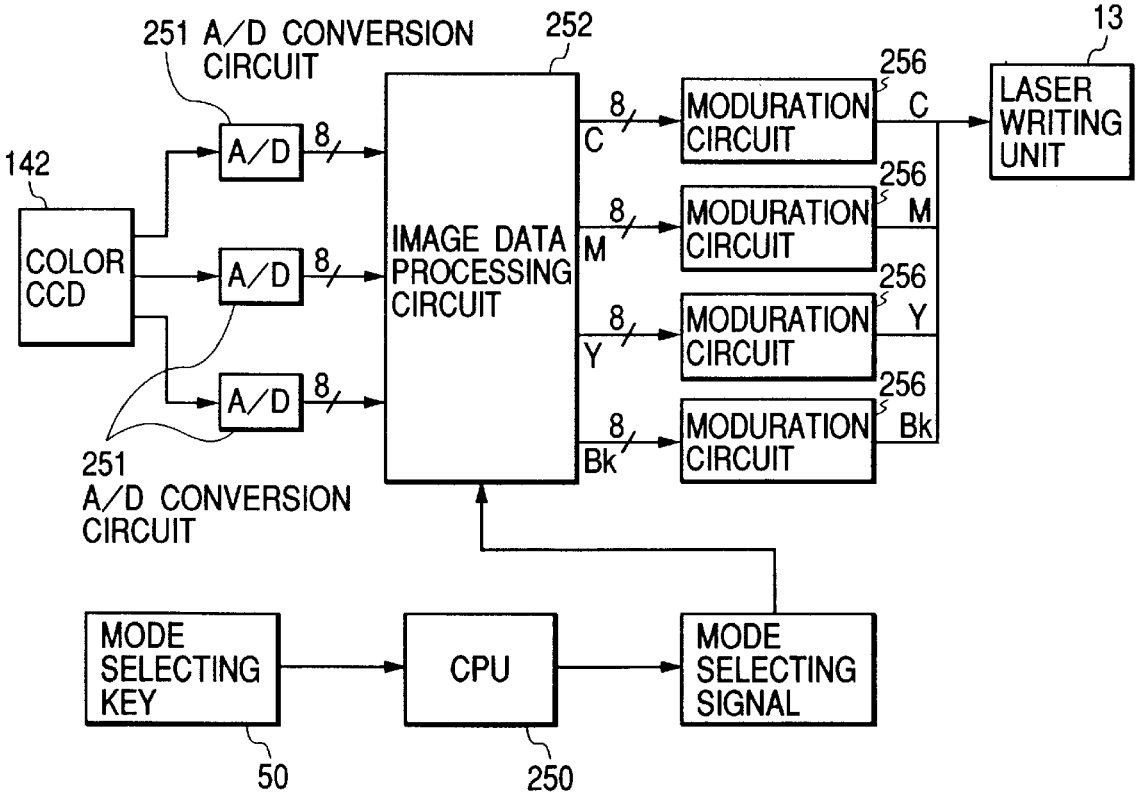
FIG. 2 is a block diagram showing an image date processing system.

Now, an embodiment of the present invention will be explained with reference to the accompanying drawings. This embodiment relates to a full-color copying machine (image forming apparatus) capable of copying a monochromatic image and a full-color image by using an electrophotographic method. FIG. 1 is a schematic constructural view showing this embodiment, and FIG. 2 is a block diagram showing an image data processing system.

First of all, an original 0 rested on an original resting plate is illuminated by illuminating means 21, and light reflected from the original is directed to a color CCD 142 through an optical system 22, thereby inputting image information of the original 0 to the CCD 142.

In the color CCD 142, the light reflected from the original 0 is color-decomposed into blue image data (B), green image data (G) and red image data (R) which are in turn outputted to an A/D converting circuit 251.

In the A/D converting circuit 251, the color image data comprised of the red (R), green (G) and blue (B) image data or monochromatic (Bk) image data is converted, for example, into image data of digital signal (image signal) having 256 gradations which is in turn outputted to an image data processing circuit 252.

In the image data processing circuit 252, among the digital signals, the color image data is converted (complementary color conversion) to obtain image data of yellow (Y), magenta (M) and cyan (C), and, for example, by effecting under color removal (referred to as "UCR" hereinafter), image data of black (Bk) is removed from the Y, M, C, image data. Further, masking treatment and color correction of the Y, M, C image data after UCR are effected.

When, a normal paper mode is selected by manipulating a mode selection key 50 provided on an operating portion, on the basis of command from a CPU 250, the masking treatmeant is performed in such a manner that the maximun number (portion) of colors in the entire image becomes 2.0 (corresponding to two colors). As a result, a maximum carrying amount (toner amount per unit area when the highest gradation is reproduced) of an ouput image obtained by a color image outputing device (described later) becomes greater than that of a monocolor by 2.0 times.

Thereafter, the first black (Bk) image signal is modulated (pulse width modulation) by a modulating circuit 256 and then is outputted to a laser writing unit 13 as light writing means (light scanning means) which will be described later. Similarly, the image signals of yellow (Y) as second color, magenta (M) as third color and cyan (C) as forth color are modulated (pulse width modulation) by the modulating circuit 256 and then is outputted to the laser writing unit 13.

Next, a method for outputting the actual color image based on the above-mentioned color image data will be explained with reference to FIG. 1 showing the color image outputting device.

In FIG. 1, the image forming apparatus comprises developing means 1 has a plurality of developing devices corresponding to repective colors disposed around an electrophotographic photosensitive drum 2 as an image bearing member (on which an electrostatic latent image is formed by exposing a laser beam 14 thereon), a transfer drum 3 for holding a recording material and for transferring an image developed on the image bearing member onto the recording material, a cleaning apparatus 4 for removing toner remaining on the image bearing member after transferring the image, a charging member 5 for applying charges having predetermined polarity to the image bearing member, a cleaning member 6 for cleaning the charging member, a fixing device 7 for thermally fixing the transferred image onto the recording material, a sheet feeding cassette 8 containing the recording materials P, a sheet feeding roller 9 for feeding the recording materials P one by one from the cassette 8, and a conveying roller pair 10 for conveying the fed recording material P.

The image bearing member 2 rotated in a direction shown by the arrow is firstly charged by the charging member 5 uniformly and then is exposure-scanned by the laser writing unit 13 with the laser beam 14 modulated (flash modulation) on the basis of the image data corresponding to the yellow image, thereby forming an electrostatic latent image corresponding to the yellow image.

The electrostatic latent image is developed of a developing device IY of the developing means 1 for supplying yellow toner to the image bearing member.

On the other hand, in synchronism with the formation of the toner image, the recording material P fed from the sheet feeding cassette 8 by the sheet feeding roller 9 is conveyed by the conveying roller pair 10 to the held on the transfer drum 3.

The, the yellow toner image is transferred onto the recording material P held on the transfer drum 3 rotated in a direction shown by the arrow.

After transferring the image, the surface of the image bearing member is cleaned by the cleaning apparatus 4.

While the recording material P to which the yellow toner image was transferred is being held by the transfer drum 3, similar to the yellow image, charging, exposing, developing and transferring processes are effected regarding magenta, cyan and black images, and these color toner images are superimposed onto the recording material, thereby forming an unfixed toner image. Then, the recording material P is separated from the transfer drum 3 and then is sent to the fixing device 7, where the unfixed toner image is thermally fixed to the recording material. Thereafter, the recording material is discharged out of the machine.

Incidentally, the image bearing member 2, charging member 5, laser writing unit 13, developing means 1, transfer drum 3 and the like constitute unfixed toner image forming means.

As fixing conditions, a diameter of a fixing roller 7*a* was 46 mm (ϕ46), wattage of a heater of the fixing roller 7*a* was 550 W, a diameter of a pressure roller 7*b* was 46 mm, wattage of a heater of the pressure roller 7*b* was 550 W, a line speed in a nip portion N between the fixing roller 7*a* and the pressure roller 7*b* of the fixing device was 117 mm/sec and a fixing temperature was 170° C. Through-put (the number of recording materials outputted (image-formed) per unit time) was 3 sheets/min.

In this case, the maximum carrying amount of toner for each color is determined by process conditions for developing and transferring.

More concretely, on the recording material, the maximum carrying amount for single color was 0.6 mg/mm$^2$, with the result that the maximum carrying amount for output image was 0.6×2.0 (color number)=1.2 mg/mm$^2$.

In this mode, in the above-mentioned conditions, when the toner image was formed on the normal paper (second recording material) (having weight smaller than 80 g/m$^2$) and the materials were passed at a speed of 3 sheets/min, it was found that a good image without poor fixing could be obtained.

Next, a case where a thick sheet mode is selected will be explained.

First Embodiment

When a mode selection key 50 is depressed to select the thick sheet mode, on the basis of control of the CPU 250, switching for enhancing the fixing ability is effected. In this embodiment, only the image processing condition was switched.

More specifically, the maximum toner carrying amount for the output image from the color image outputting device is processed by the masking process so that the maximum color number (portion) among all images becomes 1.2 corresponding to colors. On the basis of this image processing, the laser beam is emitted from the laser writing unit to form the image.

Since conditions other than the image processing condition are the same as those in the normal paper mode, the maximum carrying amount for output image became 0.6×1.2=0.72 mg/mm$^2$.

Under these conditions, even when the image was formed on thick paper having greater heat capacity as a first recording material having a thickness greater than the second recording material (concretely, A3 size paper having basis weight of 157 g/m$^2$ ), the poor fixing did not occur. As fixing conditions, the diameter of the fixing roller was 46 mm, wattage of the heater of the fixing roller was 550 W, the diameter of the pressure roller was 550 W, the line speed in the fixing devices was 117 mm/sec and the fixing temperature was 170° C. Trought-put was 3 sheets/min.

Second Embodiment

In this embodiment, when the mode selection key 50 is depressed, the developing condition is altered so that the maximum carrying amount for single color is changed from 0.6 mg/mm$^2$ (normal paper mode) to 0.4 mg/mm$^2$. More specifically, developing bias is controlled so that the maximum carrying amount is decreased by changing developing contrast from 300 V to 150 V.

Under these conditions, even when the image was formed on a thick paper having greater heat capacity (concretely, A3 size paper having basis weight of 157 g/m$^2$), the poor fixing did not occur. The fixing conditions were the same as those in the first embodiment.

Through-put was 3 sheet/min.

Third Embodiment

When the mode selection key 50 is depressed to select to thick sheet mode, on the basis of control of the CPU 250, switching for enhancing the fixing ability is effect. In this embodiment, only the image processing condition was switched.

More specifically, the maximum toner carrying amount for the output image from the color image outputting device is processed by the masking process so that the maximum color number (portion) among all images becomes 1.2 corresponding to colors.

Since conditions other than the image processing condition are the same as those in the normal paper mode, the maximum carrying amount for output image became 0.6×1.2=0.72 mg/mm$^2$.

Under these conditions, even when the image was formed onto a thick paper having greater heat capacity (concretely, a post card), the poor fixing did not occur. The fixing conditions were the same as those in the first embodiment. Through-out was 3 sheet/min. When the mode selection key 50 is depressed to select to thick sheet mode, on the basis of control of the CPU 250, switching for enhancing the fixing ability is effect. In this embodiment, only the image processing condiction was switched.

Comparative Example

As comparison, when the toner amount control according to the present invention was not effected and an image was formed on a thick paper having great heat capacity (concretely, A3 size paper having weight of 157 g/m$^2$) under the same conditions as the present invention, it was found that poor fixing occurs.

In the conventional method in which the line speed in the fixing device is decreased, when the line speed was decreased to 39 m/sec, it was found that, although poor fixing does not occur, but the through-put is reduced to 1 sheet/min.

As mentioned above, according to the embodiments, when the toner image is formed on the recording material having great heat capacity such as the thick paper, by reducing the maximum carrying amount of the toner layer in comparison with the case where the image is formed on the recording material having small heat capacity such as the normal paper by changing the image processing condition or the process condition, and, more preferably, by reducing the maximum carrying amount of the toner layer to 70% or less in comparison with the case where the image is formed on the recording material having small heat capacity such as the normal paper, the heat capacity of the toner image itself can be reduced, and the full-color image can be formed on the recording material having great heat capacity such as the thick paper without reducing the through-put.

Incidentally, even when the basis weight of the recording material is equal to or greater than 157 g/m$^2$, so long as the weight is not too great, the good image formation can be performed by applying the present invention.

Further, in the above-mentioned embodiments, while the multicolor image forming apparatus was explained, the present invention can be applied to monochromatic image forming apparatuses.

As mentioned above, while the embodiments of the present inventions were explained, the present invention is not limited to such embodiments, but various alternations and modifications can be made within the scope of the invention.

What is claimed is:

1. An image forming apparatus comprising:

unfixed toner image forming means for forming an unfixed toner image on a recording material; and fixing means for fixing the unfixed toner image formed by said unfixed toner image forming means onto the recording material;

wherein a toner maximum carrying amount of the unfixed toner image formed on a first recording material by said unfixed toner image forming means is smaller than a toner maximum carrying amount of the unfixed toner image formed on a second recording material having a thickness smaller than that of the first recording material by said unfixed toner image forming means.

2. An image forming apparatus according to claim 1, further comprising a first recording material mode and a second recording material mode, which are capable of being designated by an operator.

3. An image forming apparatus according to claim 1, wherein the toner maximum carrying amount on the first recording material is 70% or less of the toner maximum carrying amount on the second recording material.

4. An image forming apparatus according to claim 1, said image forming apparatus forms a full color image by color-mixing superposed color toners.

5. An image forming apparatus according to claim 1, wherein said unfixed toner image forming means includes an image bearing member, and light scanning means for emitting light based on image information to form a latent image on said image bearing member, and wherein the toner maximum carrying amount is changed by controlling the image information.

6. An image forming apparatus according to claim 1, wherein said unfixed toner image forming means includes an image bearing member, and developing means for developing a latent image on said image bearing member by using a developing bias voltage, and wherein the toner maximum carrying amount is changed by controlling the developing bias voltage.

7. An image forming apparatus according to claim 1, wherein a basis weight of the first recording material is equal to or greater than 157 g/m$^2$.

8. An image forming apparatus according to claim 1, wherein the first recording material is a postcard.

9. An image forming apparatus according to claim 1, wherein said fixing means includes a pair of rollers defining a nip portion by close contacting with each other, and the recording material carrying the unfixed toner image is pinched and conveyed at the nip portion, thereby the unfixed toner image is heat fixed onto the recording material.

10. An image forming apparatus according to claim 1, wherein the first recording material and the second recording material are paper.

11. An image forming apparatus comprising:

image forming means for forming an unfixed toner image on a recording material in accordance with image information;

wherein the image information is processed by said image forming means and a maximum carrying amount of the toner is determined, fixing means for fixing the unfixed toner image formed by said image forming means onto the recording material; and changing means for changing the maximum toner carrying amount, wherein said changing means changes the maximum carrying amount of the toner by making the image information different in accordance with information as to a thickness of the recording material.

12. An image forming apparatus according to claim 11, further comprising a plurality of recording material modes, which are capable of being designated by an operator, wherein said changing means changes the maximum carrying amount of the toner in accordance with a mode selected by the operator.

13. An image forming apparatus according to claim 11, wherein the toner maximum carrying amount on a first recording material is 70% or less of the toner maximum carrying amount on a second recording material.

14. An image forming apparatus according to claim 11, wherein said image forming apparatus forms a full color image by color-mixing a plurality of superposed color toners.

15. An image forming apparatus according to claim 11, wherein said fixing means includes a pair of rollers defining a nip portion by close contacting with each other, and the recording material carrying the unfixed toner image is pinched and conveyed at the nip portion, thereby the unfixed toner image is heat fixed onto the recording material.

16. An image forming apparatus according to claim 11, wherein the recording material is paper.

* * * * *

UNITED STATES PATENT AND TRADEMARK OFFICE

CERTIFICATE OF CORRECTION

PATENT NO. : 6,434,345 B2
DATED : August 13, 2002
INVENTOR(S) : Yukio Watanabe

It is certified that error appears in the above-identified patent and that said Letters Patent is hereby corrected as shown below:

Drawings,
Sheet 2, “MODURATION” (all occurrences) should read -- MODULATION --.

Column 1,
Line 12, “an” (second occurrence) should be deleted;
Line 31, “multi-color” should read -- multicolor --; and
Line 66, “through-out.” should read -- through-put. --.

Column 2,
Line 21, “date” should read -- data --; and
Line 32, “constructural” should read -- constructional --.

Column 3,
Line 11, “forth” should read -- fourth --;
Line 13, “is” should read -- are --;
Line 20, “has” should read -- having --;
Line 54, “the” (second occurrence) should read -- be --; and
Line 56, “The, the” should read -- The --.

Column 5,
Line 2, “Trought-put” should read -- Through-put --;
Line 25, “effect.” should read -- effected. --;
Line 43, “Through-out” should read -- Through-put --; and
“When the mode selection key” should be deleted;
Lines 44 through 46, should be delected; and
Line 61, “but” should be deleted.

Column 6,
Line 14, “the” should be deleted;
Line 23, “alternations” should read -- alterations --;
Line 32, “material;” should read -- material, --; and
Line 49, “said” should read -- wherein said --.

UNITED STATES PATENT AND TRADEMARK OFFICE

CERTIFICATE OF CORRECTION

PATENT NO. : 6,434,345 B2
DATED : August 13, 2002
INVENTOR(S) : Yukio Watanabe

It is certified that error appears in the above-identified patent and that said Letters Patent is hereby corrected as shown below:

Column 7,
Line 19, “information;” should read -- information, --;
Line 23, “determined,” should read -- determined; --; and
Lines 25 and 26, “image ¶forming” should read -- image forming --.

Signed and Sealed this

Fourth Day of February, 2003

JAMES E. ROGAN
*Director of the United States Patent and Trademark Office*